US006732480B1

(12) United States Patent
Smith et al.

(10) Patent No.: US 6,732,480 B1
(45) Date of Patent: May 11, 2004

(54) ADJUSTABLE ROOF PLATFORM

(76) Inventors: Derek J. Smith, #38 10776 Guliford Drive, Surrey, BC (CA), V3R 1W6; Joshua A. Malhame, #38 10776 Guliford Drive, Surrey, BC (CA), V3R 1W6

( * ) Notice: Subject to any disclaimer, the term of this patent is extended or adjusted under 35 U.S.C. 154(b) by 0 days.

(21) Appl. No.: 10/463,127

(22) Filed: Jun. 18, 2003

(51) Int. Cl.[7] ..... E04B 2/82
(52) U.S. Cl. ..... 52/126.1; 52/749.12
(58) Field of Search ..... 248/455, 456, 248/457; 52/749.12, 749.1, 126.1, 126.2; 108/9

(56) References Cited

U.S. PATENT DOCUMENTS

| | | | | | |
|---|---|---|---|---|---|
| 1,026,097 | A | | 5/1912 | Lewis | |
| 1,028,362 | A | | 6/1912 | King | |
| 1,306,434 | A | | 6/1919 | Melanson | |
| 2,844,908 | A | * | 7/1958 | Moore | 108/9 |
| 3,239,297 | A | * | 3/1966 | Bosko et al. | 312/231 |
| 4,116,413 | A | * | 9/1978 | Andersen | 248/451 |
| 4,848,243 | A | * | 7/1989 | Giordano | 108/9 |
| 4,985,602 | A | * | 1/1991 | Kouhia | 178/18.03 |
| 5,249,397 | A | | 10/1993 | Monaco | |
| 5,474,271 | A | | 12/1995 | Raymond | |
| 5,913,782 | A | | 6/1999 | Monaco et al. | |
| 6,000,663 | A | * | 12/1999 | Plasse et al. | 248/27.8 |

FOREIGN PATENT DOCUMENTS

| | | | | |
|---|---|---|---|---|
| DE | 3718014 A1 | * | 12/1988 | E04D/15/02 |
| GB | 2229482 A | * | 9/1990 | E04D/15/00 |

* cited by examiner

*Primary Examiner*—Milton Nelson, Jr.

(57) ABSTRACT

An adjustable roof platform includes a panel having a top surface and a bottom surface. A peripheral wall is attached to and extends downward from the bottom surface of the panel. A front elongated member, a rear elongated member, a first side elongated member and second side elongated member are coupled together to define a frame base. The rear elongated member is hingedly coupled to the peripheral wall such that a bottom edge of the peripheral wall may be selectively positioned abutted against or positioned away from the first side, second side and front elongated members. A pair of supports selectively supports the panel in an angular relationship with respect to the frame base. A plurality of foot members is attached to a lower surface of the frame base. Each of the foot members comprises a non-skid material.

9 Claims, 3 Drawing Sheets

ADJUSTABLE ROOF PLATFORM

BACKGROUND OF THE INVENTION

1. Field of the Invention

The present invention relates to knock-down roof platforms and more particularly pertains to a new knock-down roof platform for providing a parallel work station for a person on a roof.

2. Description of the Prior Art

The use of knock-down roof platforms is known in the prior art. U.S. Pat. No. 5,249,397 and U.S. Pat. No. 5,913,872 each describe a device which include a platform having adjustable legs positioned at the front of the platform. A problem with this structure is that a majority of the force placed on these platforms is exerted toward the adjustable legs which causes the rear edge of the platforms, which are positioned directly on the roof, to both move upwards away from the roof and allow for little in the way of surface tension between these rear edges and the roofs.

While these devices fulfill their respective, particular objectives and requirements, the need remains for a device that provides better traction between the device and the roof. Also required is a device which can support a greater variety of roof angles without changing the structure of the device.

SUMMARY OF THE INVENTION

The present invention meets the needs presented above by incorporating a frame pivotally attached to a panel. The frame spaces the panel from the roof and thus gravitational force is placed on a rear portion of the frame to allow for greater surface tension to exist between the device and the roof.

Another object of the present invention is to provide a new knock-down roof platform that utilizes a plurality of non-skid feed attached to the frame to further enhance the traction between the roof and the platform.

Still another object of the present invention is to provide a new knock-down roof platform that includes supports between the frame and the panel that allows great variation in the angle between the panel and the frame.

To this end, the present invention generally comprises a panel having a top surface, a bottom surface, a front edge, a back edge, a first side edge and a second side edge. A peripheral wall is attached to and extends downward from the bottom surface of the panel. A front elongated member, a rear elongated member, a first side elongated member and second side elongated member are coupled together to define a frame base. The frame base has substantially the same size and shape as the panel. The rear elongated member is hingedly coupled to the peripheral wall adjacent to the back edge such that a bottom edge of the peripheral wall may be selectively positioned abutted against or positioned away from the first side, second side and front elongated members. A pair of supports selectively supports the panel in an angular relationship with respect to the frame base. A plurality of foot members is attached to a lower surface of the frame base. Each of the foot members comprises a non-skid material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
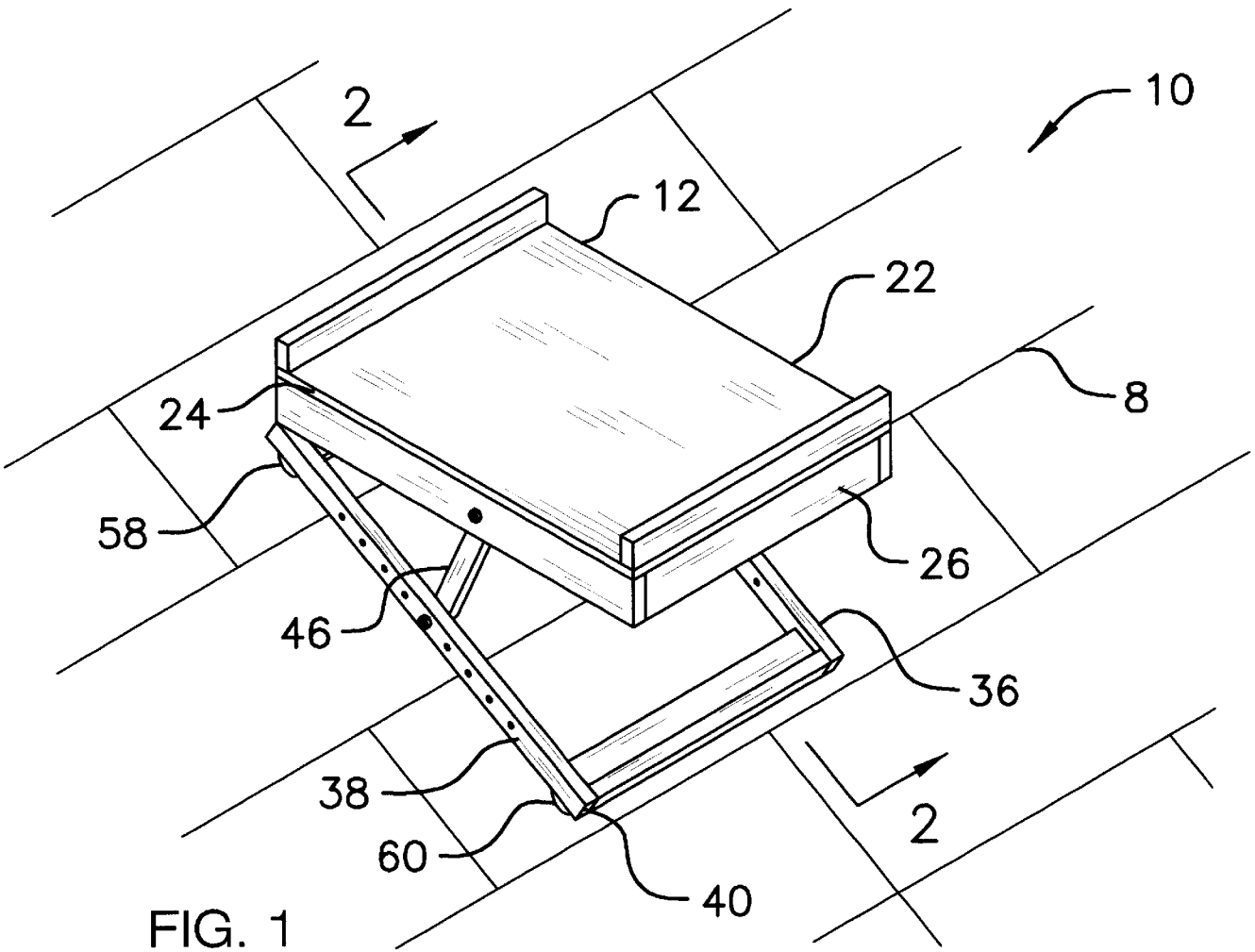
FIG. 1 is a schematic perspective view of an adjustable roof platform according to the present invention.
Figure 2:
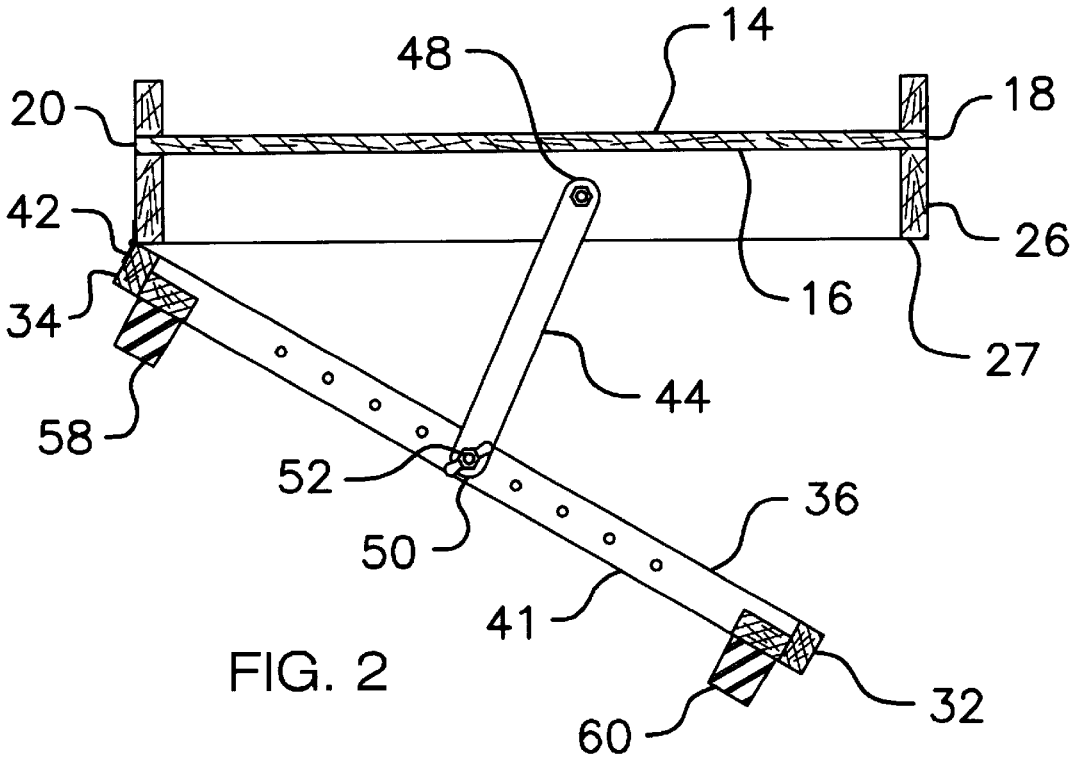
FIG. 2 is a schematic cross-sectional view taken along 2–2 of the present invention.
Figure 3:
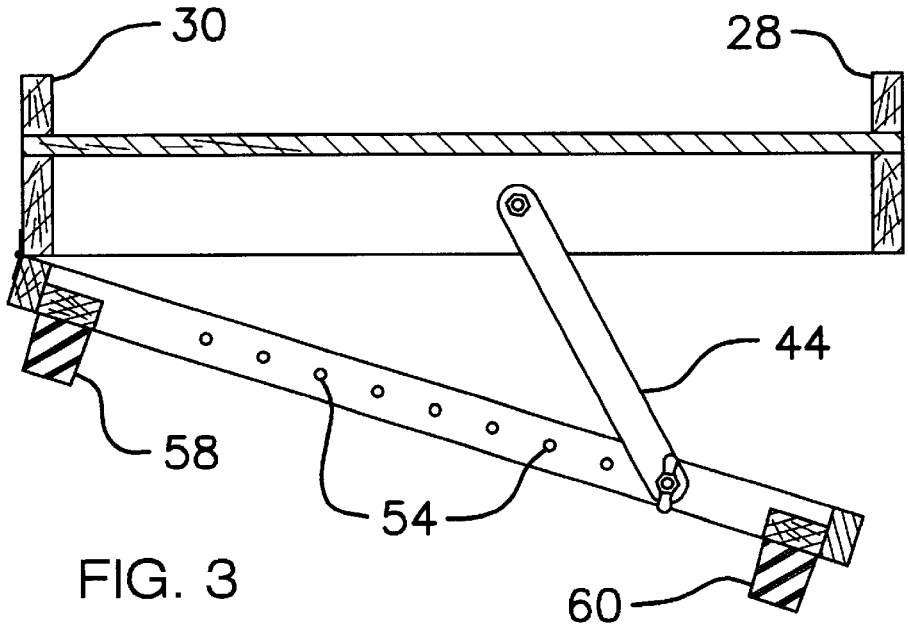
FIG. 3 is a schematic cross-sectional view of the present invention showing the support being repositioned with respect to FIG. 2.
Figure 4:
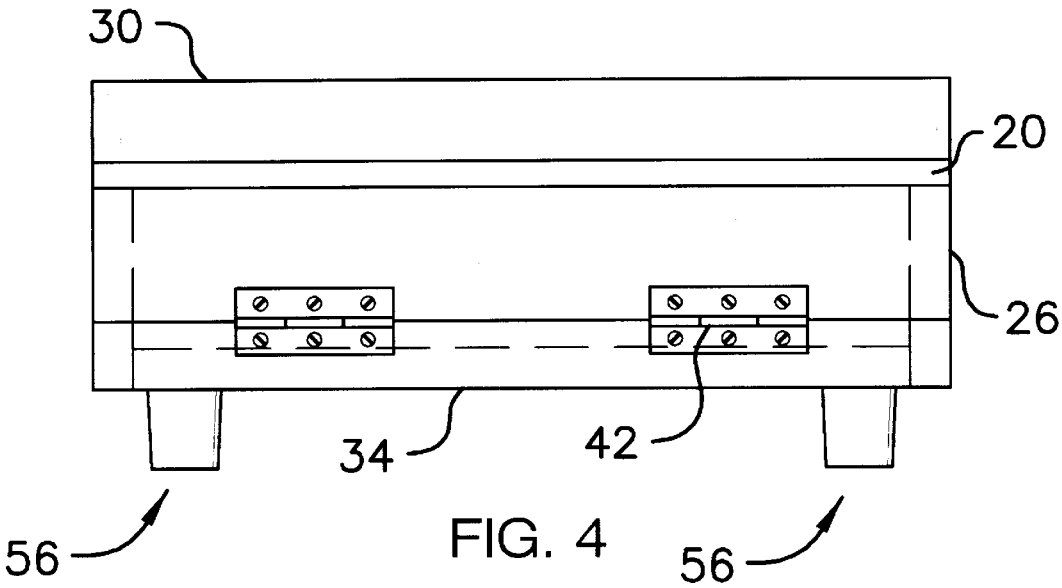
FIG. 4 is a schematic rear view of the present invention.
Figure 5:
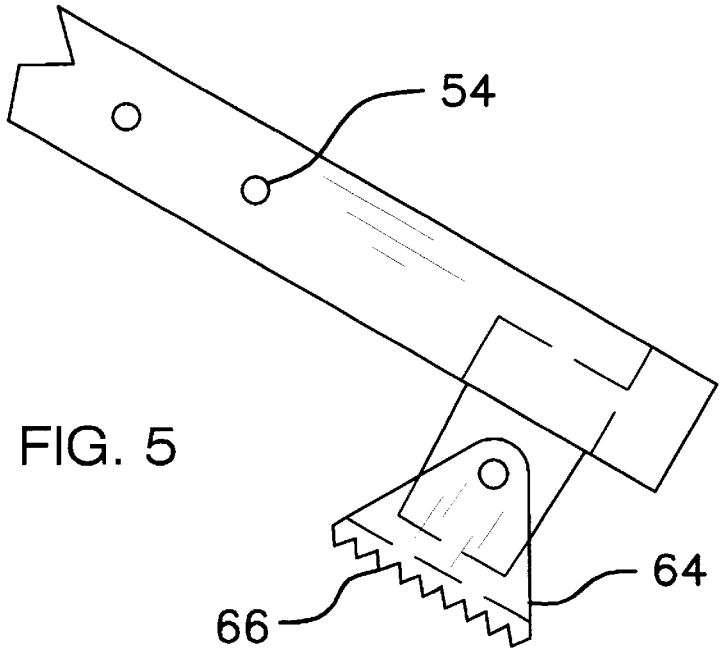
FIG. 5 is a schematic side view of a gripping member of the present invention.

With reference now to the drawings, and in particular to FIGS. 1 through 5 thereof, a new knock-down roof platform embodying the principles and concepts of the present invention and generally designated by the reference numeral 10 will be described.

As best illustrated in FIGS. 1 through 5, the adjustable roof platform 10 generally comprises a panel 12 having a top surface 14, a bottom surface 16, a front edge 18, a back edge 20, a first side edge 22 and a second side edge 24. The panel 12 has a generally rectangular shape. A peripheral wall 26 is attached to and extends downward from the bottom surface 16 of the panel 12. A front lip 28 is preferably attached to and extends upwardly from the front edge 18. Optionally, a rear lip 30 is attached to and extends upwardly from the back edge 20.

A front elongated member 32, a rear elongated member 34, a first side elongated member 36 and second side elongated member 38 are coupled together to define a frame base 40. The frame base 40 has substantially the same size and shape as the panel 12. The rear elongated member 34 is hingedly coupled by a hinge 42 to the peripheral wall 26 adjacent to the back edge 20 such that a bottom edge 27 of the peripheral wall 26 may be selectively positioned abutted against or positioned away from the first side 36, second side 38 and front 32 elongated members.

A pair of supports 44, 46 selectively supports the panel 12 in an angular relationship with respect to the frame base 40. Each of the supports 44, 46 is attached to and extends between the peripheral wall 26 and the frame base 40. Each of the supports 44, 46 comprises an arm having a first end 48 and a second end 50. The first ends 48 are pivotally coupled to the peripheral wall 26 and each of the second ends 50 is removably coupled to one of the first 36 and second 38 side elongated members. The first ends 48 are preferably positioned generally near a central area between the front edge 18 and back edge 20 of the panel 12. Each of a pair of securing members 52 is removably positioned through one of the arms, or supports 44, 46, adjacent to the second ends 50 and into one of a plurality of aligned holes 54 extending through the first 36 and second 38 elongated members. The holes 54 extend between the front 32 and rear 34 elongated members.

Each of a plurality of foot members 56 is attached to a lower surface 41 of the frame base 40. The foot members are spaced from each other such that each is preferably positioned adjacent to one of four corners of the frame base 40. The foot members 56 comprise a non-skid material, which is preferably an elastomeric material. The plurality of foot members 56 ideally include four foot members wherein there are a pair of rear foot members 58 adjacent to the rear elongated member 34 and a pair of front foot members 60 adjacent to the front elongated member 32.

Optionally, each of a pair of gripping members 64 is removably attached to a bottom side of one of the front foot members 60. These would preferably comprise metal boots including a plurality of teeth 66 extending away from the foot members 60 when the gripping members 64 are attached thereto.

In use, the frame base 40 is positioned on a roof 8 such that the foot members 56 may grip the roof 8. For roofs 8 that are particularly steep or slippery, the gripping members 64 may be used to aid in the non-slippage of the frame 40 on the roof 8. The user adjusts the supports 44 until the panel 12 is relatively parallel. The use of the frame base 40 allows for non-skid foot members 56 in both the front and the back of the device 10 and by hingedly coupling the frame base 40 to the panel 12, more downward pressure is exerted on the back of the device 10 relative to the front of the device to provide more traction between the frame 40 and the roof 8. The front 28 and rear 30 lips prevent tools from falling off of the panel 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An adjustable platform device for selectively positioning on a roof, said device comprising:

a panel having a top surface, a bottom surface, a front edge, a back edge, a first side edge and a second side edge, a peripheral wall being attached to and extending downward from said bottom surface of said panel;

a front elongated member, a rear elongated member, a first side elongated member and second side elongated member being coupled together to define a frame base, said frame base having substantially the same size and shape as said panel, said rear elongated member being hingedly coupled to said peripheral wall adjacent to said back edge such that a bottom edge of said peripheral wall may be selectively positioned abutted against or positioned away from said first side, second side and front elongated members;

a pair of supports for selectively supporting said panel in an angular relationship with respect to said frame base; and a plurality of foot members being attached to a lower surface of said frame base, each of said foot members comprising a non-skid material.

2. The adjustable platform device as in claim 1, further including a front lip being attached to and extending upwardly from said front edge.

3. The adjustable platform device as in claim 2, further including a rear lip being attached to and extending upwardly from said back edge.

4. The adjustable platform device as in claim 1, wherein each of said supports is attached to and extending between said peripheral wall and said frame base, each of said supports comprising an arm having a first end and a second end, each of said first ends pivotally coupled to said peripheral wall and each of said second ends being removably coupled to one of said first and second side elongated members.

5. The adjustable platform device as in claim 4, wherein each of a pair of securing members being removably positioned through one of said arms adjacent to said second ends and into one of a plurality of aligned holes extending through said first and second elongated members.

6. The adjustable platform device as in claim 1, wherein each of said foot members is positioned adjacent to one of four corners of said frame base.

7. The adjustable platform device as in claim 1, wherein said non skid material comprises an elastomeric material.

8. The adjustable platform device as in claim 1, wherein there are a pair of rear foot members adjacent to said rear elongated member and a pair of front foot members adjacent to said front elongated member, a pair of gripping members, each of-said gripping members being removably attached to a bottom side of one of said front foot members, each of said gripping members including a plurality of teeth extending away from an attached one of said front foot members.

9. An adjustable platform device for selectively positioning on a roof, said device comprising:

a panel having a top surface, a bottom surface, a front edge, a back edge, a first side edge and a second side edge, said panel having a generally rectangular shape, a peripheral wall being attached to and extending downward from said bottom surface of said panel;

a front lip being attached to and extending upwardly from said front edge;

a rear lip being attached to and extending upwardly from said back edge;

a front elongated member, a rear elongated member, a first side elongated member and second side elongated member being coupled together to define a frame base, said frame base having substantially the same size and shape as said panel, said rear elongated member being hingedly coupled to said peripheral wall adjacent to said back edge such that a bottom edge of said peripheral wall may be selectively positioned abutted against or positioned away from said first side, second side and front elongated members;

a pair of supports for selectively supporting said panel in an angular relationship with respect to said frame base, each of said supports being attached to and extending between said peripheral wall and said frame base, each of said supports comprising an arm having a first end and a second end, each of said first ends pivotally coupled to said peripheral wall and each of said second ends being removably coupled to one of said first and second side elongated members, each of a pair of securing members being removably positioned through one of said arms adjacent to said second ends and into one of a plurality of aligned holes extending through said first and second elongated members;

a plurality of foot members being attached to a lower surface of said frame base, said foot members being spaced from each other, each of said foot members being positioned adjacent to one of four corners of said frame base, each of said foot members comprising a non-skid material, said non skid material comprising an elastomeric material, wherein there are a pair of rear foot members adjacent to said rear elongated member and a pair of front foot members adjacent to said front elongated member; and a pair of gripping members, each of said gripping members being removably attached to a bottom side of one of said front foot members, each of said gripping members including a plurality of teeth extending away from an attached one of said front foot members.

* * * * *